US006029737A

United States Patent [19]

Mancini

[11] Patent Number: 6,029,737

[45] Date of Patent: Feb. 29, 2000

[54] SEALING AND GUIDING DEVICE FOR THE INJECTION PISTON OF A HOT CHAMBER PUMP FOR CORROSIVE ALLOYS

[76] Inventor: Flavio Mancini, Contrada Bassiche, 37, Brescia, Italy, 25122

[21] Appl. No.: 09/000,090

[22] PCT Filed: May 24, 1996

[86] PCT No.: PCT/IT96/00108

§ 371 Date: Jan. 23, 1998

§ 102(e) Date: Jan. 23, 1998

[87] PCT Pub. No.: WO97/04902

PCT Pub. Date: Feb. 13, 1997

[30] Foreign Application Priority Data

Jul. 25, 1995 [IT] Italy ..... M195A1605

[51] Int. Cl.[7] ..... B22D 17/04

[52] U.S. Cl. ..... 164/316; 164/410; 164/318; 222/596

[58] Field of Search ..... 164/316, 410, 164/312, 314, 318; 222/596

[56] References Cited

U.S. PATENT DOCUMENTS

| | | | |
|---|---|---|---|
| 3,467,171 | 9/1969 | Fulgenzi et al. | 164/316 |
| 3,586,095 | 6/1971 | Fulgenzi | 164/316 |
| 3,777,943 | 12/1973 | Spalding | 222/385 |
| 4,091,970 | 5/1978 | Komiyama | 164/316 |
| 4,505,317 | 3/1985 | Prince | 164/153 |
| 5,385,456 | 1/1995 | Mancini | 164/316 |

FOREIGN PATENT DOCUMENTS

| | | |
|---|---|---|
| 0576406 | 12/1993 | European Pat. Off. . |
| 1178540 | 5/1959 | France . |
| 2405103 | 5/1979 | France . |
| 745583 | 5/1943 | Germany . |

*Primary Examiner*—Harold Pyon
*Assistant Examiner*—I.-H. Lin
*Attorney, Agent, or Firm*—Kenyon & Kenyon

[57] ABSTRACT

A sealing and guiding device for the injection piston (3) of a hot chamber pump for corrosive alloys made up of a body (1) in which a chamber (6) and an injection cavity (2) therebelow are formed, wherein the piston (3) slides with a vertical reciprocating motion (V), includes a bush (8), having an outer diameter smaller than said chamber (6), interposed between centering members housed in the chamber (6) and made coaxial with the chamber (6) and with the piston (3) by a pair of opposite surfaces of revolution (12, 13) formed on said centering members, the upper surface (13) and the relevant centering member performing a pressure-tight sealing. The outer lateral surface (15) of the bush (8) is in communication with the injection cavity (2) whereas the upper side of the bush (8) is in communication with the crucible and immersed therein at a depth (L), measured from the lowest level (23) reachable by the molten alloy, which is greater than the maximum travel (C) of the piston (3). The inner surface (21) of the bush (8) is a surface of revolution with diameter just larger than the piston (3).

10 Claims, 1 Drawing Sheet

SEALING AND GUIDING DEVICE FOR THE INJECTION PISTON OF A HOT CHAMBER PUMP FOR CORROSIVE ALLOYS

FIELD OF THE INVENTION

The present invention relates to the sealing devices used in pumps for the injection die forming of metallic pieces, and in particular for the hot chamber die casting of corrosive light alloys.

BACKGROUND OF THE INVENTION

It is known that even if the use of hot chamber pumps, in which the injection pump is totally or partially immersed in the molten alloy, solves most of the problems of cold chamber pumps, yet it presents the great drawback that when said alloy at melting temperature is corrosive for the ferrous materials, the members of the pumps are rapidly etched by it.

An example of a traditional hot chamber pump dating back to 1940 is disclosed in DE-C-745.583 relating to an improved arrangement for the alignment of the injection piston with the cylinder abutting against the flat top of the gooseneck. This traditional type of pump does not allow high injection pressure and is not suitable for corrosive alloys.

The continuous research of new corrosion-resistant materials, capable of assuring a sufficient life and reliability to the parts exposed to the contact with the corrosive alloys, has led to the development of alloys of various elements such as titanium, boron, silicon, carbon, chromium and aluminum and rarer elements such as yttrium, lanthanum, scandium, cesium, samarium, zirconium, etc. The aim of the research of alloys more and more corrosion-resistant is that of extending the operating life of the pump, mainly as far as the most critical members such as the piston and the cylinder are concerned, which are not only subject to the corrosion by the molten alloy, but they also have to withstand the abrasion caused by the motion of the piston sealably sliding in the cylinder.

In conventional pumps, the play which occurs between piston and cylinder owing both to the thermal expansion and the surface corrosion is extremely damaging for the correct working of the pump. In fact, the introduction of the molten alloy into the cylinder usually takes place through an opening in the side wall of the cylinder which is closed by the piston in its downward stroke with the consequent impossibility of using low rigidity piston rings which would be damaged by the passage on the side opening. FR-A-1.178.540 discloses an example of such a pump, wherein the replacement of the members undergoing corrosion and wear is easy, fast and economical. However this pump is designed for the casting of magnesium alloys, which are not corrosive for the types of metallic materials used nowadays and allow the use of elastic piston rings In other cases, such as in patents CH625.439, U.S. Pat. Nos. 3,467,171 and 3,469,621, the piston has its lower end cut at 45° or somehow machined to obtain therein a loading mouth so as to allow the inflow of the molten alloy into the cylinder without extracting completely the piston and without forming openings in the side wall of the cylinder. Nonetheless, the piston must sealably slide in the cylinder, and therefore the problem of the coupling tolerances between piston and cylinder remains. Even if metallic piston rings can be applied in this case in order to improve the sealing, said rings wear down rather rapidly thus requiring the replacement thereof after few thousands of cycles.

Moreover, their presence implies a limitation of the maximum operating pressure, so as to prevent excessive friction and wear, which in some cases is insufficient to obtain casts of the required compactness.

The maximum pressure may be considerably limited also by sealing problems between the container cylinder wherein the injection piston slides and the seat of the gooseneck siphon wherein said cylinder is housed. This occurs especially if said members are made of different materials, such as in the typical case of a cylinder made of corrosion-resistant ceramic material and a siphon made of coated steel. A further problem stems from the fragility of said ceramic materials which are sensible to bending stresses.

From the above it is apparent that in prior art pumps special surfacings are needed for the critical coupling between piston and cylinder, in which account must be taken of the problems of thermal expansion, friction between the parts, corrosion of the contacting surfaces and possible oxide scales on said surfaces. Similar problems arise in the coupling area between cylinder and siphon, and the whole of these problems implies a shortening of the life of the above-mentioned critical members of the pump with consequent costs, both in terms of pieces replacement and machine stop times for the inspection and/or maintenance thereof.

The applicant has already been granted the U.S. Pat. No. 5,385,456 which discloses a hot chamber pump with a plunger piston. In this way, the cylinder is integral with the siphon, and the sealing is not performed between piston and cylinder but through seals of compressed yielding material located at the mouth of the siphon. Though it substantially solves several of the above-mentioned problems, said pump has limited achievable pressure and injection speed due to the presence of said yielding materials. In fact, it is necessary to limit the pressure in order to prevent an excessive expansion of said materials in the direction transverse to the lateral surface of the piston, in addition to limiting the maximum piston speed in order to prevent an excessive heat production due to the friction.

SUMMARY OF THE INVENTION

Therefore the object of the present invention is to provide a sealing and guiding device suitable to overcome the above-mentioned operating limitations.

A first essential advantage of the present sealing device is that it is made up of high-rigidity members which allow high injection pressures.

A second considerable advantage consists in achieving a reliable hydrodynamic guide with no direct contact between the members, with take up of the radial and axial plays and without problems of speed limit.

DETAILED DESCRIPTION

Figure 1:
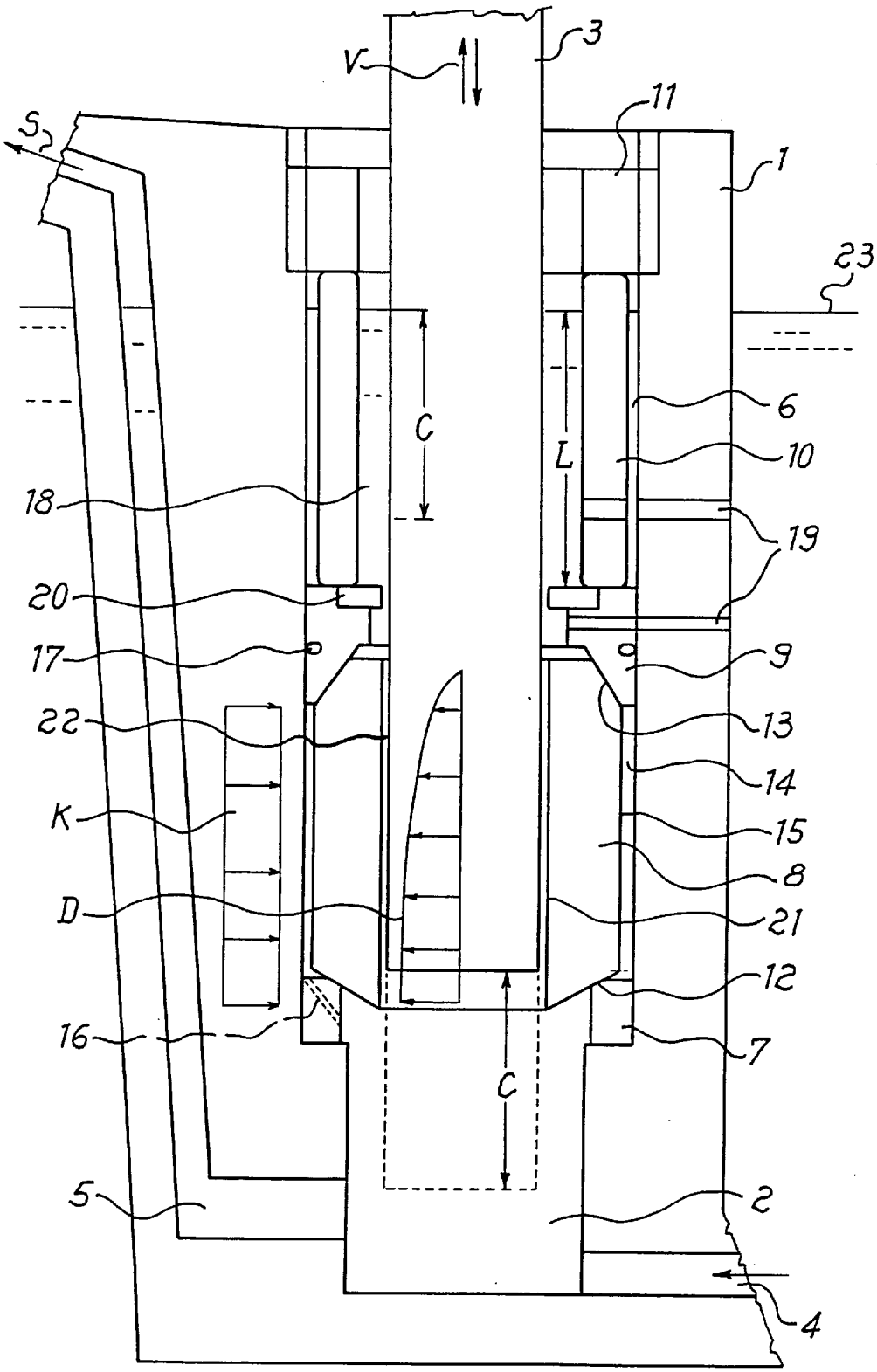
FIG. 1 schematically illustrates a vertical cross-section of a device according to the present invention.

Referring to said figure, there is seen that a hot chamber die casting pump consists of a body 1, immersed in the molten alloy contained in a crucible (not shown), in which an injection cavity 2 is formed at the bottom, wherein a cylindrical plunger piston 3 slides with a vertical reciprocating motion V. The feeding of the molten alloy into cavity 2 takes place through a channel 4 provided with suitable means for the opening and closing thereof, while a sprue 5 takes the alloy under pressure to the mold (not shown) as indicated by arrow S.

A cylindrical chamber 6, wherein the sealing and guiding device according to the present invention is housed, is formed in the upper portion of body 1 with a diameter larger than the injection cavity 2 and coaxial therewith. Starting from the bottom, said device includes a lower centering ring 7, a bush 8, an upper centering ring 9, a compression sleeve 10 and a threaded locknut 11. The lower ring 7 rests on the abutment at the bottom of chamber 6 and is centered therein, since its outer diameter is equal to that of chamber 6, same as the upper ring 9. On the contrary, bush 8 interposed between rings 7 and 9 has an outer diameter smaller than chamber 6 but larger than the inner diameter of the centering rings, and it is made coaxial with chamber 6 and piston 3 by a pair of opposite, preferably conical, surfaces of revolution 12 and 13 respectively formed on the upper side of the lower ring 7 and on the lower side of the upper ring 9.

The annular space 14 included between the outer surface 15 of bush 8 and the wall of chamber 6 is in communication with the injection cavity 2 through a channel 16 formed in the lower ring 7, or possibly through leakages at the lower seat 12. On the contrary, the upper seat 13 is pressure-tight and the sealing between the upper ring 9 and chamber 6 may be further assured by a known device such as an O-ring 17.

The space 18 of chamber 6, above bush 8, is in communication with the crucible through channels 19 formed in the wall of body 1, of sleeve 10 and of ring 9, or in other suitable ways. The feeding of the molten alloy into cavity 2 can thus take place also by partially or totally extracting piston 3 from bush 8, depending on whether the former is shaped at its end to form a loading mouth or not. Anyway, a scraping ring 20 can be placed along the edge of the upper ring 9 so as to prevent the bath floss from being taken by piston 3 inside bush 8. The diameter of piston 3 is just smaller than the inner diameter of bush 8, whereby a thin chamber or channel 22, which has been considerably enlarged in the drawing for the sake of clarity, remains between the inner surface 21 of bush 8 and the lateral cylindrical surface of piston 3. In order to reduce possible hydrodynamic unbalances, the inner surface 21 may be interrupted by grooves orthogonal to the axis.

After having schematically described the members of the pump, now the operation thereof will be described, while defining P' the pressure on the free surface of the bath of molten alloy, and P" the maximum pressure which can be generated by the motor of piston 3 inside cavity 2.

It is clear that while piston 3 enters cavity 2 the pressure increases from P' (neglecting the different heights of the various members) to a value P lower than or equal to P". Since the pump is of the volumetric type, value P can equal P" if the flow rate of the losses due to leakages is lower than the effective flow rate generated by piston 3, this being so much easier as the losses are small. With reference to what was said above about the sealing between space 14 and space 18, these losses can only occur through channel 22 and proportionally to the characteristics thereof. In particular, the losses increase with the increase in pressure P and in the width of channel 22, and they decrease when the length of the latter, measured along the generatrix, increases. In order to achieve a good working of the pump it is essential to find a good compromise for the width of channel 22. In fact, it has to be sufficiently large to allow a proper play at high injection speed without causing excessive friction, yet sufficiently small as to limit the losses and provide an effective guide to piston 3.

As mentioned in the introductory part, the ceramic materials which resist corrosion and friction have a good behaviour in case of compression stress but do not withstand high bending stresses. Due to this, piston 3 which is subjected almost to Pascal's pressure can be made of ceramic materials, whereas body 1 has to be made of properly coated metal. Moreover, one has to take into account the considerable differences in the coefficient of thermal expansion between ceramic and metallic materials, with the consequent coupling problems which can give rise to excessive plays or interferences. Therefore it is clear that bush 8 has to be made of a material similar to that of piston 3, with similar or equal coefficients which leave unchanged the width of channel 22 upon varying of the temperature. This implies that bush 8 be not subjected to tensile stress, and that its housing in chamber 6 be made so as to prevent the onset of plays which jeopardize the sealing or of interferences which generate dangerous stresses thereon.

The device according to the present invention overcomes the above-mentioned drawbacks by making the other sealing and guiding members, apart from piston 3 and bush 8, of suitable metallic alloys having thermal expansion coefficients compatible with one another, and therefore with couplings defined on the base of the operating temperature. The scraping ring 20, if present, can be made of ceramic material so as to maintain the correct play with piston 3.

The system for centering bush 8, consisting of the surfaces of revolution 12 and 13, allows the coupling between materials with different thermal expansion by simultaneously adjusting the radial and axial play of bush 8 with respect to body 1, even pre-loading the former if necessary. This is achieved by pressing downwards the upper ring 9 through sleeve 10 by acting on locknut 11, which also allows, upon stopping of the pump, the unlocking of the device prior to the beginning of the cooling so as to prevent possible damages caused by the thermal shrinkage.

The feeding of the molten alloy into the mold substantially takes place in three steps. During the starting step of ejection of the air from the mold, piston 3 is lowered slowly and generates into the injection cavity a pressure P close to P'. During the intermediate step of mold filling, piston 3 is lowered very rapidly and generates a high pressure P for a very short time. During the final step of feeding of the shrinkages of the solidifying cast, the pressure becomes and remains very high, but piston 3 is lowered slowly according to the speed allowed by the little flow rates of the shrinkages and of the leakages.

When the pressure in cavity 2, and thus also in the annular space 14, reaches a certain value P, the outer surface 15 of bush 8 is subjected to said constant pressure P along its generatrix, as schematized by diagram K. On the contrary, the inner surface 21 is subjected to a decreasing pressure while going up along a generatrix, namely from value P in cavity 2 to value P' in space 18, as exemplified by diagram D. The exact law of variation of the pressure along surface 21 depends on the conformation of channel 22. Therefore the pressures acting on the lateral surfaces of bush 8 have resultants directed towards the longitudinal axis, whose values can be obtained from the difference between diagram K and diagram D.

Furthermore, it should be noted that bush 8 is also subjected to axial compression due to the pressure P>P' acting on the lower side, and to the corresponding reaction of seat 13 acting on the upper side. This push of pressure P causes an expansion of ring 9 and the consequent pressure-tight sealing thereof against the wall of chamber 6.

Since piston 3 and bush 8 are made of materials with similar characteristics, the effect of the centripetal pressure increasing along the generatrix is that bush 8 contracts more than piston 3, also due to the decreasing pressure acting on the latter, thus leading to a decrease in the width of channel 22. Through a proper sizing of bush 8, it is possible to define the axial development of the width of channel 22 according to the characteristics of the alloy to be cast, thus allowing high injection speeds and low losses due to leakages. In particular, bush 8 preferably has increasing inner diameters towards space 18, in the absence of stresses, so as to obtain an inner cylindrical surface 21 during the final feeding step, when the bush is in the stressed condition. In fact, the greatest leakage flow rates occur in said final step due to the combination of high pressure and long duration of the step, whereas in the two preceding steps the flow rate is negligible since pressure (in the first step) or time (in the second step) are very small.

The above is valid supposing that piston 3 remains substantially cylindrical; therefore it is necessary to prevent that during its vertical reciprocating motion the temperature changes along the generatrix are such as to cause significant differences of diameter in its active portion, i.e. the portion which performs the sealing within bush 8. To this purpose, the scraping ring 20, if present, or the upper edge of bush 8 anyway, are immersed in the molten alloy at a depth L greater than the maximum travel C of the piston, said depth L being measured from the lowest free surface 23 which can be reached by the molten alloy bath. In this way, the active portion of piston 3 is constantly at the bath temperature since it is still immersed therein even at the maximum travel, thus remaining cylindrical.

It is clear that the above-described and illustrated embodiment of the device according to the invention is just an example susceptible of various modifications. In particular, the law of variation of the inner surface 21 of bush 8 may be designed according to the specific requirements of the case, and the same is valid for the angles of the surfaces 12 and 13. Moreover, bush 8 can also extend beyond the latter.

What is claimed is:

1. A hot chamber injection apparatus for corrosive alloys including a body which, when operating, is immersed in a molten alloy contained in a crucible, wherein the body forms a chamber above an injection cavity and includes an injection piston reciprocally sliding vertically therein, an upper portion of the chamber being in communication with the crucible through a plurality of first ducts, the cavity being in fluid communication with the crucible and with a mold via a plurality of second ducts and sealing/guiding means for the piston extending between the upper portion and the cavity, wherein the sealing/guiding means includes:

first and second centering members mounted in the chamber, wherein the first centering member forms an upper surface of revolution and the second centering member forms a lower surface of revolution; and a bush having an outer diameter smaller than an inner diameter of the chamber, the bush being interposed between the first and second centering members so that the upper and lower surfaces of revolution maintain the bush coaxial with the chamber, the upper surface of revolution forming a pressure-tight sealing against an upper side of the bush and the first centering member forming a pressure-tight sealing against the sidewall of the chamber, wherein an outer lateral surface of the bush is in fluid communication with the injection cavity through a channel in the second centering member, the upper side of the bush being immersed in the crucible to a depth which, when measured from a lowest level reachable by a surface of the molten alloy, is greater than a maximum travel of the piston, and wherein an inner surface of the bush is a surface of revolution with a diameter slightly larger than an outer diameter of the piston.

2. An apparatus according to claim 1, wherein the first and second centering members consist of an upper ring and a lower ring, respectively, an outer diameter of each of the upper and lower rings being equal to an inner diameter of the chamber and an inner diameter of each of the upper and lower rings being smaller than the outer diameter of the bush.

3. An apparatus according to claim 1, wherein at least one of the upper and lower surfaces of revolution is conical.

4. An apparatus according to claim 1, wherein, when in an unstressed state, the inner surface (21) of the bush is a conical surface with an inner diameter of the bush increasing toward a top of the bush.

5. An apparatus according to claim 1, wherein the inner surface of the bush is interrupted by a plurality of grooves extending orthogonal to an axis of the bush.

6. An apparatus according to claim 1, further comprising at least one scraping ring mounted adjacent to the top of the bush.

7. An apparatus according to claim 6, wherein the bush, the piston and the at least one scraping ring are made of ceramic material.

8. An apparatus according to claim 6, wherein a depth to which the scraping ring is immersed in the crucible, when measured from the lowest level reachable by the molten alloy, is greater than the maximum travel of the piston, the depth to which the scraping ring is immersed being less than the depth to which the bush is immersed.

9. An apparatus according to claim 1, further comprising a plurality of locking members, wherein the body, the upper and lower centering members and the locking members are made of metallic alloys coated with corrosion resistant materials.

10. An apparatus according to claim 9, further comprising a locking member including a sleeve abutting the upper centering member and locked at a top thereof by a threaded locknut.

* * * * *